United States Patent [19]

Spamer et al.

[11] Patent Number: 4,530,548

[45] Date of Patent: Jul. 23, 1985

[54] ARTICLE DISPENSER

[75] Inventors: William S. Spamer, Roswell; Ronald J. Beerman, Atlanta, both of Ga.

[73] Assignee: The Mead Corporation, Dayton, Ohio

[21] Appl. No.: 504,519

[22] Filed: Jun. 15, 1983

[51] Int. Cl.[3] ..... A47F 7/00

[52] U.S. Cl. ..... 312/45; 312/259; 211/59.2; 211/72; 211/189

[58] Field of Search ..... 211/49 D, 14, 72, 73, 211/189, 184; 312/45, 72, 73, 259; 206/44.12; 221/67; 229/15, 17 B, 7 R, 42

[56] References Cited

U.S. PATENT DOCUMENTS

| | | | |
|---|---|---|---|
| 1,341,893 | 6/1920 | Fitzgerald | 312/45 X |
| 1,378,534 | 5/1921 | Fitzgerald | 229/17 B |
| 1,764,468 | 6/1930 | Pratt | 206/44.12 |
| 1,840,439 | 1/1932 | Ewell | 206/44.12 |
| 1,968,880 | 8/1934 | Ebert | 211/189 X |
| 2,000,915 | 5/1935 | Blake | 211/189 X |
| 2,146,420 | 2/1939 | Davidson | 206/45.12 |
| 2,269,303 | 1/1942 | Backstrom | 211/189 |
| 2,299,027 | 10/1942 | Novak | 312/45 X |
| 2,382,191 | 8/1945 | Weichselbaum | 211/49 D X |
| 2,543,875 | 3/1951 | Silverman | 211/189 X |
| 2,785,843 | 3/1957 | Shaw | 206/44.12 X |
| 2,996,344 | 8/1961 | Garman | 312/45 |
| 3,178,242 | 4/1965 | Ellis et al. | 312/45 |
| 3,298,763 | 1/1967 | Domenico | 312/45 |
| 3,904,105 | 9/1975 | Booth | 229/15 |
| 4,283,000 | 8/1981 | White | 229/17 B |
| 4,358,047 | 11/1982 | Raubenheimer | 229/15 |
| 4,401,255 | 8/1983 | Conroy et al. | 229/17 B X |

*Primary Examiner*—Ramon S. Britts
*Assistant Examiner*—Blair Johnson
*Attorney, Agent, or Firm*—Rodgers & Rodgers

[57] ABSTRACT

An article dispenser comprising an article receiving compartment and bottom tray in combination, a series of vertical separators and article platforms interconnected and disposed interiorly of the dispenser, and a portion of the bottom tray extending outwardly so as to expose and facilitate removal of the articles.

12 Claims, 6 Drawing Figures

ARTICLE DISPENSER

TECHNICAL FIELD

This invention relates to a storage and gravity dispensing system for articles so as to allow incremental movement of the articles to a forward or dispensing position by means of which they can be individually removed from the dispenser by a customer.

BACKGROUND ART

Various article dispensing systems are known in the art and are generally characterized by simplicity in design wherein the dispensers are fabricated of metal and generally comprise downwardly sloping article storage and dispensing trays. These systems are normally permanent installations and allow little or no space for advertising material.

DISCLOSURE OF THE INVENTION

By this invention an article dispenser is provided and comprises a bottom tray, an article receiving compartment disposed in the bottom tray, a vertical separator upstanding from the bottom tray, an article platform interconnected with the vertical separator, the vertical separator and article platform assembly being disposed generally in the article receiving compartment, the article platform adapted to support the articles, and one portion of the bottom tray extending outwardly in order to receive and expose at least one article.

BEST MODE FOR CARRYING OUT THE INVENTION

Figure 5:
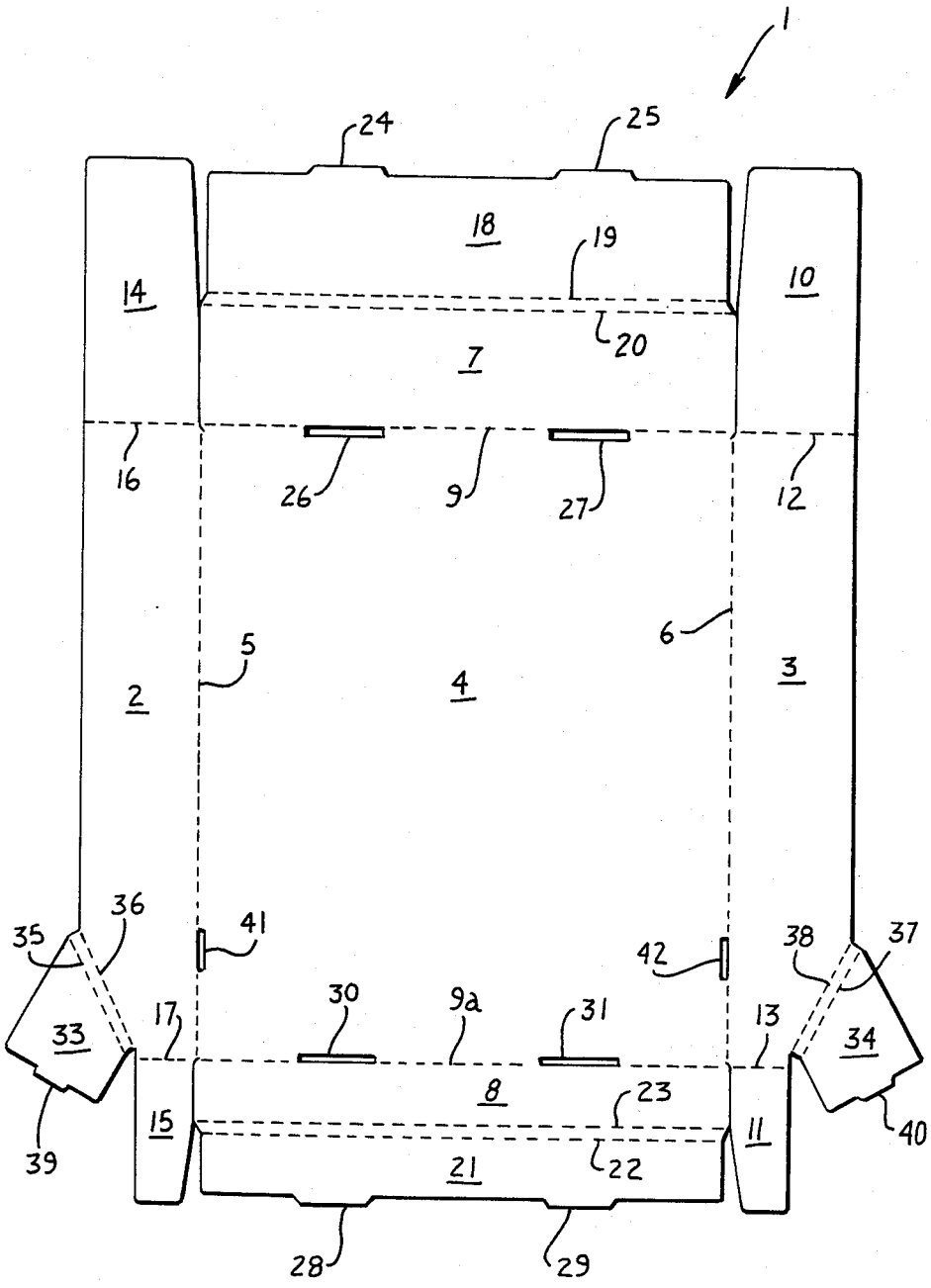
FIG. 5 is a plan view of the blank from which the bottom tray is formed.

In the drawings and with particular reference to FIG. 5, the numeral 1 generally designates the bottom tray formed according to this invention. More specifically side panels 2 and 3 are joined to bottom wall 4 respectively along fold lines 5 and 6. Similarly side panels 7 and 8 are joined to bottom wall 4 respectively along fold lines 9 and 9*a*.

Flaps 10 and 11 are joined respectively to the ends of side panel 3 along fold lines 12 and 13. The structure at the opposite side of the blank is similar in that flaps 14 and 15 are joined respectively to the ends of side panel 2 along fold lines 16 and 17. Also locking panel 18 is joined to the upper edge of side panel 7 along spaced fold lines 19 and 20. Similarly locking panel 21 is joined to side panel 8 along spaced fold lines 22 and 23. Tabs 24 and 25 are integrally formed on the free edge of locking panel 18 and are adapted to cooperate respectively with slots 26 and 27. Likewise tabs 28 and 29 are formed on the free edge of locking panel 21 and are adapted to cooperate with slots 30 and 31 formed in bottom wall 4.

According to a feature of this invention, locking flaps 33 and 34 are joined diagonally respectively to side panels 2 and 3. More specifically locking flap 33 is diagonally joined to side panel 2 along spaced fold lines 35 and 36 and, in similar fashion, locking flap 34 is diagonally joined to side panel 3 along spaced fold lines 37 and 38. Also tabs 39 and 40 are formed respectively on the free end edges of locking flaps 33 and 34 and are adapted to cooperate respectively with slots 41 and 42.

Figure 6:
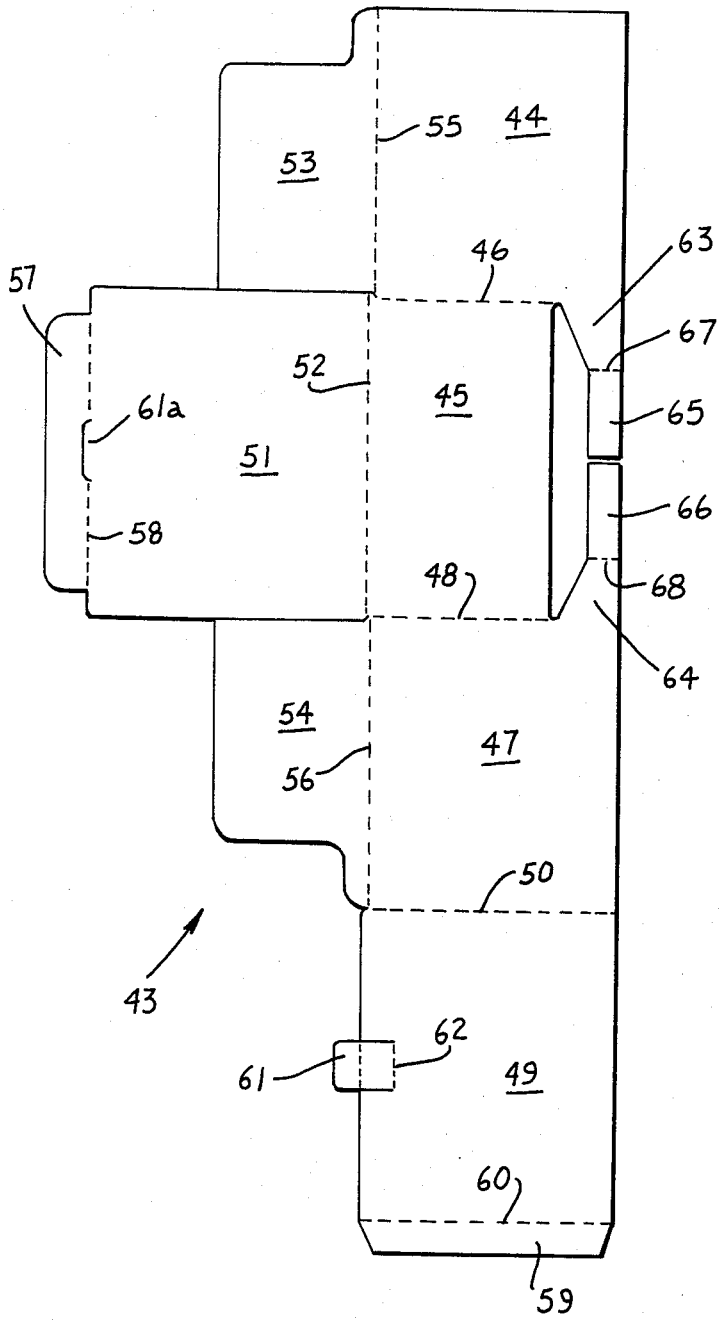
FIG. 6 is a plan view of a blank from which an article receiving compartment is formed.

As best viewed in FIG. 6, the article receiving compartment depicted in blank form and formed according to this invention is generally designated by the numeral 43. More specifically article receiving compartment 43 comprises side wall 44 to the side edge of which side wall 45 is joined along fold line 46. Also side wall 47 is joined to side wall 45 along fold line 48 and side wall 49 is joined to side wall 47 along fold line 50. Top wall 51 is joined to the upper edge of side wall 45 along fold line 52 and top flaps 53 and 54 are joined respectively to the upper edges of side walls 44 and 47 along fold line 55 and 56.

In addition, flap 57 is joined to top wall 51 along fold line 58. Also glue flap 59 is joined to a side edge of side wall 49 along fold line 60. The closure structure for article receiving compartment 43 is provided in the form of tab 61 which is joined to side wall 49 along fold line 62 and which in turn is adapted to cooperate with slot 61*a* formed along fold line 58.

According to one aspect of this invention, securing tabs 63 and 64 are integrally joined respectively to side walls 44 and 47. In addition locking tabs 65 and 66 are joined respectively to securing tabs 63 and 64 along fold lines 67 and 68.

Figure 4:
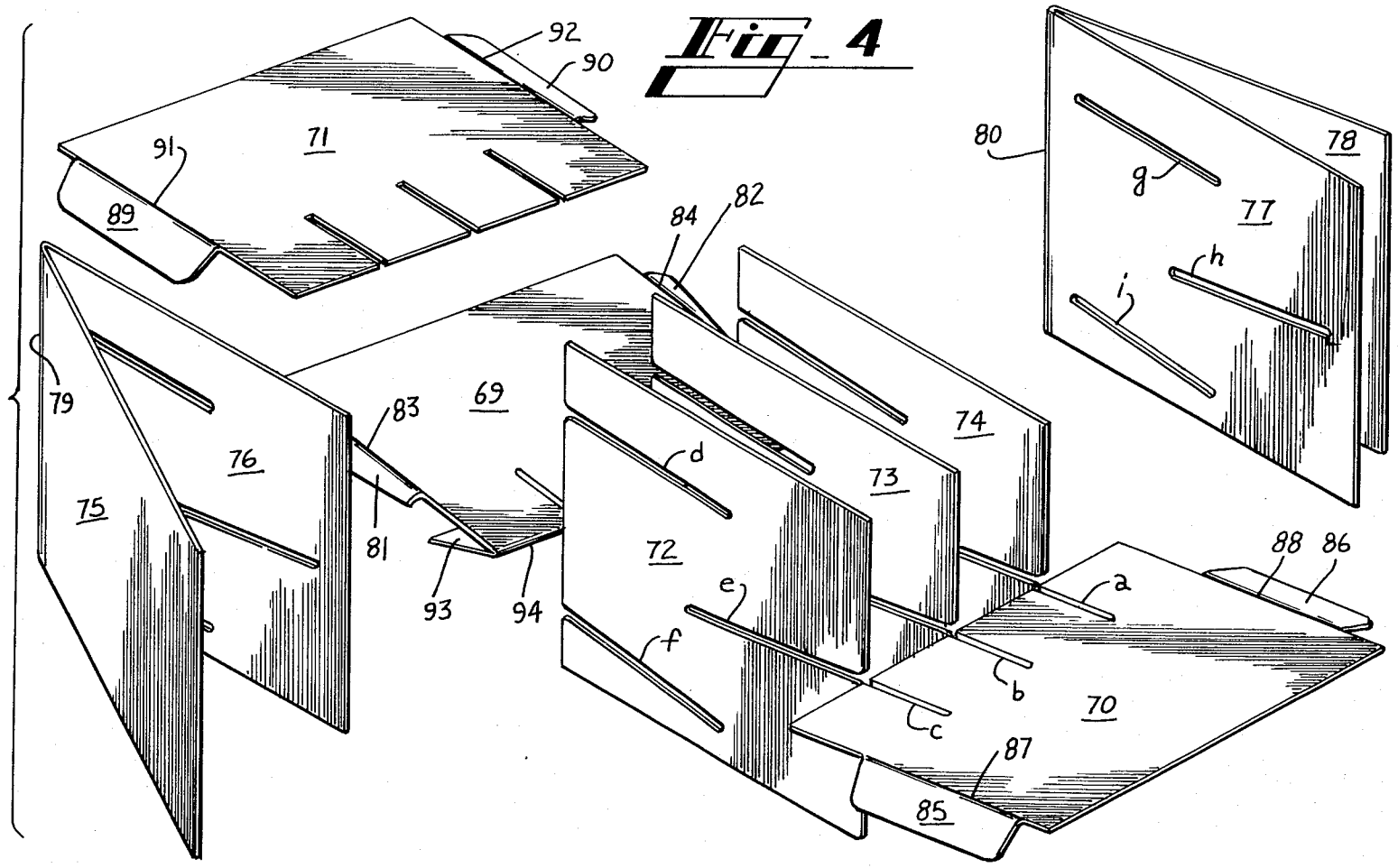
FIG. 4 is an exploded perspective view of the interior structure of the article dispenser.

The article support and separation structure for the dispenser is best shown in FIG. 4 and comprises article platforms 69,70 and 71 and vertical separators 72, 73 and 74. In addition side supports are provided in the form of support panels 75 and 76 on the one hand and support panels 77 and 78 on the other hand. Also support panels 75 and 76 are joined along fold line 79, and in similar fashion, support panels 77 and 78 are joined along fold line 80.

In order to interconnect the various elements shown in FIG. 4, slits a, b and c are formed in each of the article platforms 69, 70 and 71. Also angularly disposed and downwardly sloping slits d, e and f are formed in vertical separators 72, 73 and 74. Finally slits g, h and i are formed in support panels 76 and 77.

Also side tabs 81 and 82 are joined respectively to article platform 69 along fold lines 83 and 84. Side tabs 85 and 86 are joined respectively to article platform 70 along fold lines 87 and 88 and side tabs 89 and 90 are joined to article platform 71 along fold lines 91 and 92. Cushioning flap 93 is joined to article platform 69 along fold line 94. Although not shown in the drawings, slits a, b and c extend from article platform 69 into and completely through cushioning flap 93.

In order to form the dispenser according to this invention, initially side panels 2 and 3 of bottom tray 1 are folded upwardly respectively along fold lines 5 and 6. Then flaps 10, 11, 14 and 15 are folded inwardly to positions whereby they are disposed 90 degrees with respect to side panels 2 and 3. Then side panel 7 is folded upwardly to a position whereby the inner surface thereof is disposed in flat face contacting relation to the outer surfaces of flaps 10 and 14. Generally simultaneously with this operation, locking panel 18 is folded over into a position of flat face contacting relation with the inner surfaces of flaps 10 and 14 and tabs 24 and 25 are inserted into slots 26 and 27 respectively.

Figure 2:
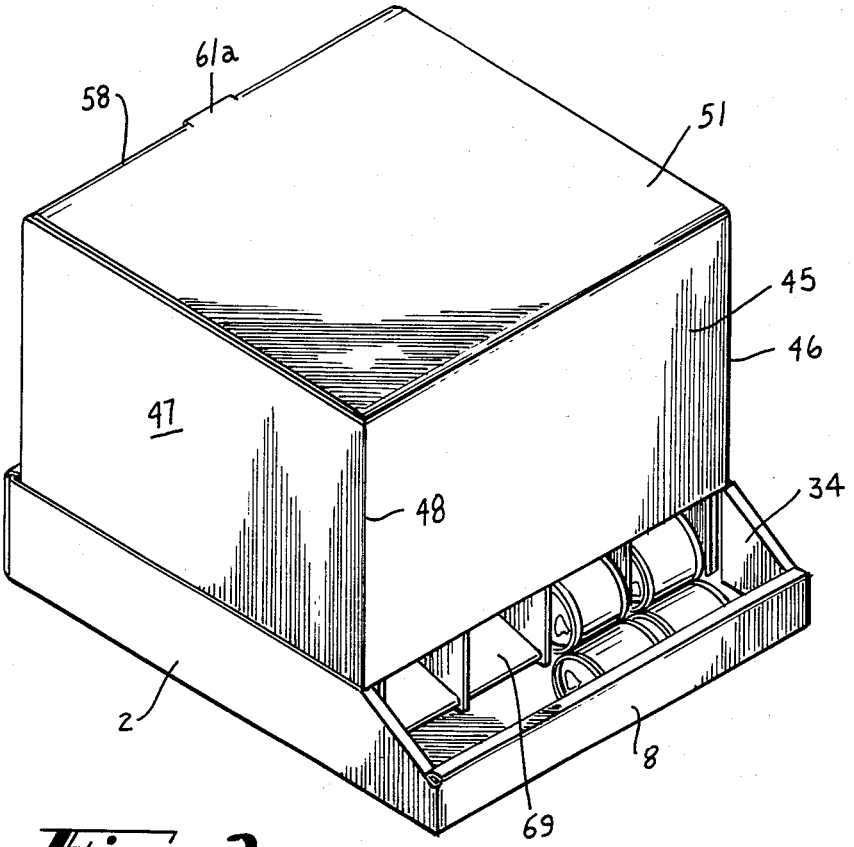
FIG. 2 is a perspective view of a completed article dispenser.

Then the article receiving compartment, as shown in blank form in FIG. 6, is formed by placing side walls 44, 45, 47 and 49 in a rectangular configuration. Glue is applied to glue flap 59, during manufacture, which in turn is secured to the free end of side wall 44. Then locking tabs 65 and 66 are folded inwardly 90 degrees with respect to securing tabs 63 and 64. Following this, article receiving compartment 43 is placed within bottom tray 1 as best shown in FIG. 2. Flaps 11 and 15 are then folded inwardly 90 degrees respectively along fold lines 13 and 17 and side panel 8 is folded upwardly into face contacting relationship with the outer surfaces thereof. Generally simultaneously with this operation, locking panel 21 is folded upwardly and over flaps 11 and 15 of bottom tray 1 as well as locking tabs 65 and 66 of article receiving compartment 43. Finally tabs 28 and 29 are inserted respectively into slots 30 and 31 in order to hold the structure securely in place.

Figure 3:
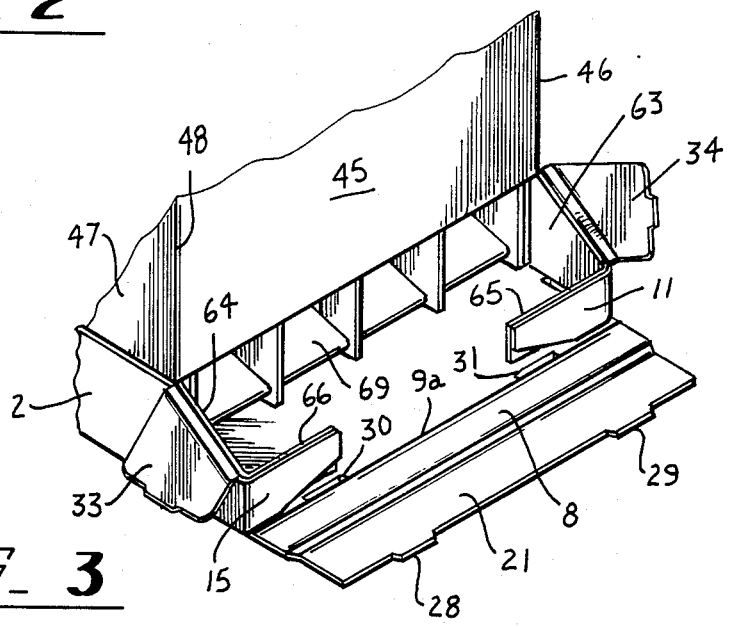
FIG. 3 is a perspective view of a portion of a dispenser during formation thereof.

For the purpose of further securing the dispenser, locking flaps 33 and 34 are folded upwardly and over into face contacting relationship with the inner surfaces respectively of securing tabs 63 and 64 and tabs 39 and 40 are inserted respectively in slots 41 and 42. This operation is best shown in FIG. 3.

In order to form the interior structure of the dispenser, vertical separators 72, 73 and 74 are positioned in vertical positions and article platform 71 is interlocked therewith by cooperation of slots a, b and c of article platform 71 and corresponding slots d of vertical separators 72, 73 and 74. Similarly article platform 70 is inserted into vertical separators 72, 73 and 74 by the cooperation of slots a, b and c of article platform 70 and corresponding slots e of vertical separators 72, 73 and 74. Following this, cushioning flap 93 is folded downwardly and under article platform 69 and then slots a, b and c of cushioning flap 93 and article platform 69 are inserted in corresponding slots f of vertical separators 72, 73 and 74.

Figure 1:
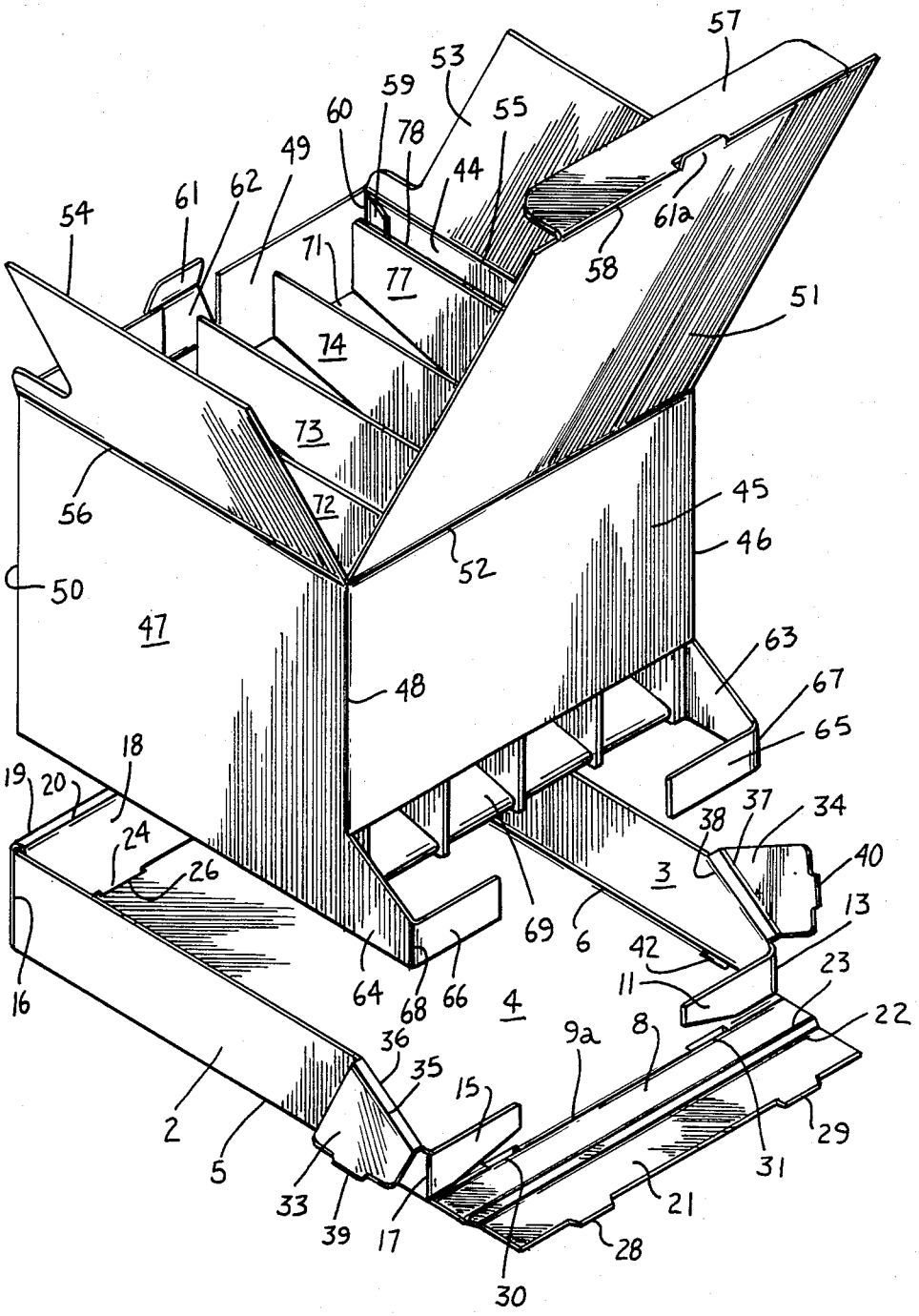
FIG. 1 is an exploded perspective view of the article dispenser formed according to this invention.

To complete the interior structure, side tabs 82, 86 and 90 are inserted in corresponding slots i, h and g of support panel 77. In similar fashion, side tabs 81, 85 and 89 are inserted into corresponding slots i, h and g of support panel 76. Then side tabs 82, 86, 90, 81, 85 and 89 are simply folded downwardly into positions approximately 90 degrees to the corresponding article platforms 69, 70 and 71. Then support panels 75 and 78 are simply folded respectively along fold lines 79 and 80 into positions of abutment with respect to the corresponding side tabs. The completed interior unit is then simply inserted into the article dispenser to a position as best shown in FIG. 1. The lower edges of side tabs 81 and 82 are disposed in abutting relationship with bottom wall 4 to enhance the desired angular disposition of article platforms 69, 70 and 71.

Then the dispenser is loaded with the desired articles such as cans of wine, beer or soft drinks by placing the articles in one of the slots formed by article platform 71 and the respective vertical separators. Since article platform 71 is tilted downwardly as best shown in FIG. 4 with the lower end thereof spaced from the corresponding side wall 45, an article is allowed to roll down article platform 71 whereby it is then deposited onto article platform 70. In similar fashion, the article rolls down article platform 70 and is similarly deposited onto lowermost article platform 69. The initial article then continues to roll and comes to a rest within the outwardly extending portion of bottom tray 1 as best shown in FIG. 2. This procedure is continued until the article dispenser is completely filled as desired. Top flaps 53 and 54 are then folded downwardly and top wall 51 is positioned in face contacting relationship with the upper surfaces of top flaps 53 and 54. The entire dispenser is then locked by means of cooperation between locking tab 61 and slot 61*a*.

INDUSTRIAL APPLICABILITY

By this invention, an article dispenser is provided which is constructed of temporary material such as corrugated paper or paperboard but is also well adapted for fabrication of more permanent materials such as plastic. The dispenser can be used in a refrigerated or nonrefrigerated environment and is well suited for the placement of large amounts of advertising thereon. As the customer extracts one of the exposed articles which is disposed in the outwardly extending portion of the bottom tray, the succeeding article moves conveniently into view in a convenient and efficient manner.

We claim:

1. An article dispenser comprising a bottom tray, an article receiving compartment extending upwardly from said bottom tray, said bottom tray comprising one side portion, said article receiving compartment comprising multiple side walls, a vertical separator upstanding from said bottom tray, an article platform disposed in interlocking relation with said vertical separator and angularly disposed with respect to an imaginary horizontal plane, said one side portion of said bottom tray extending outwardly with respect to the corresponding side wall of said article receiving compartment, said bottom tray comprising a bottom wall, said bottom wall comprising side edges, side panels joined respectively to said side edges of said bottom wall and extending upwardly therefrom, said article receiving compartment comprising four side walls interconnected in a rectilinear relationship, said side walls comprising lower portions respectively, and securing tabs extending respectively from said lower portions of two opposing of said side walls and being disposed in face contacting relation respectively with two of said side panels disposed adjacent each end of said outwardly extending portion.

2. An article dispenser according to claim 1 wherein a side support is disposed on one side of said article platform in interlocked relation thereto.

3. An article dispenser according to claim 2 wherein said side support comprises a pair of support panels foldably joined together.

4. An article dispenser according to claim 1 wherein said two side panels adjacent respectively said securing tabs comprise diagonal edges.

5. An article dispenser according to claim 4 wherein locking flaps are joined respectively to said diagonal edges and are disposed respectively in overlapping relation with said securing tabs.

6. An article dispenser according to claim 1 wherein said side panels comprise inner surfaces respectively and wherein locking tabs are joined respectively to the ends of said securing tabs remote from said opposing side walls and are disposed perpendicular thereto and in face contacting relation with said inner surface of the side panel associated with said outwardly extending portion of said bottom tray.

7. An article dispenser according to claim 6 wherein said side panels comprise upper edges respectively, said locking tabs comprise inner edges respectively, and a locking panel is joined to said upper edge of said associated side panel and portions thereof are disposed in face contacting relation with said inner edges of said locking tabs.

8. An article dispenser according to claim 1 wherein said article platform comprises an uppermost portion and wherein a second article platform is disposed in interlocking relation with said vertical separator and in ascending relation with respect to said uppermost portion of said article platform.

9. An article dispenser according to claim 1 wherein said article platform comprises a lowermost portion and wherein said lowermost portion of said article platform is disposed adjacent said outwardly extending portion.

10. An article dispenser according to claim 1 wherein said side walls comprise top edges respectively and wherein a top wall is joined to said top edge of one of said side walls and is disposed perpendicular thereto.

11. An article dispenser according to claim 1 wherein said article platform comprises a side edge and wherein a side tab is joined to said side edge of said article platform and is disposed perpendicular thereto.

12. An article dispenser according to claim 1 wherein said article platform comprises a lower edge and wherein a cushioning flap is joined to the lower edge of said article platform.

* * * * *